US006859350B1

(12) United States Patent
Corbetta et al.

(10) Patent No.: US 6,859,350 B1
(45) Date of Patent: Feb. 22, 2005

(54) DEVICE FOR CONTROLLING AN ELECTRIC SWITCHGEAR AND RELATED METHOD

(75) Inventors: Giuliano Corbetta, Milan (IT); Roberto Borlotti, Bagnatica (IT)

(73) Assignee: ABB Technology AG, Zurich (CH)

( * ) Notice: Subject to any disclaimer, the term of this patent is extended or adjusted under 35 U.S.C. 154(b) by 136 days.

(21) Appl. No.: 10/168,698

(22) PCT Filed: Oct. 27, 2000

(86) PCT No.: PCT/EP00/10702

§ 371 (c)(1),
(2), (4) Date: Oct. 3, 2002

(87) PCT Pub. No.: WO01/48775

PCT Pub. Date: Jul. 5, 2001

(30) Foreign Application Priority Data

Dec. 23, 1999 (EP) ..... 99204501

(51) Int. Cl.[7] ..... H01H 47/00
(52) U.S. Cl. ..... 361/139
(58) Field of Search ..... 361/139, 152; 307/139, 143, 140; 318/265; 700/29, 28, 19, 31, 30, 37, 39, 71, 44; 703/2, 6, 13, 20, 24

(56) References Cited

U.S. PATENT DOCUMENTS

| | | | | | |
|---|---|---|---|---|---|
| 5,673,165 | A | * | 9/1997 | Kuhn et al. | 361/154 |
| 6,291,911 | B1 | * | 9/2001 | Dunk et al. | 307/137 |
| 6,331,687 | B1 | * | 12/2001 | Dunk et al. | 218/140 |
| 6,531,841 | B1 | * | 3/2003 | Elli et al. | 318/466 |
| 6,538,347 | B1 | * | 3/2003 | Baranowski et al. | 307/137 |
| 6,693,777 | B1 | * | 2/2004 | Cereda et al. | 361/5 |

FOREIGN PATENT DOCUMENTS

| | | | |
|---|---|---|---|
| DE | 2601799 | A1 | 7/1977 |
| DE | 3150814 | A1 | 6/1983 |
| DE | 19544207 | A1 | 6/1997 |
| WO | WO 96/36982 | A1 | 11/1996 |

* cited by examiner

*Primary Examiner*—Brian Sircus
*Assistant Examiner*—James A Demakis
(74) *Attorney, Agent, or Firm*—Connolly Bove Lodge & Hutz LLP; Larry J. Hume

(57) ABSTRACT

A device for controlling the opening/closing operation of an electric switchgear in a power disribution network comprising a control unit, for controlling an electromagnetic actuator operatively connected to the movable contact of said switchgear. Said control unit includes first processing means for generating, based on predefined data, a first control signal which is indicative of the actual law of motion of said movable contact of the switchgear.

19 Claims, 3 Drawing Sheets

DEVICE FOR CONTROLLING AN ELECTRIC SWITCHGEAR AND RELATED METHOD

BACKGROUND

The present invention relates to a device for controlling the opening/closing operation of an electrical switchgear, such as a circuit breaker or a disconnector or a recloser or the like, and a control method related.

More specifically, the present invention relates to a device, which allows controlling the opening/closing operation of an electric switchgear, using a real time sensor-less control system.

Devices for controlling the opening/closing operation of an electric switchgear are well known in the state of the art.

An example of this kind of control devices, particularly useful for medium and high voltage applications (i.e. for a voltage range higher than 1 KV), is disclosed in the European patent application N° 98204083.4, filed in the name of the same applicant, the description of which is to be understood as included herein, as reference.

In the mentioned patent application, it is disclosed a device for controlling the opening/closing operation of an electric switchgear, which is able to adjust in real time the control parameters in input to an actuator. In this way, it is possible to obtain a desired law of motion for movable parts of the electric switchgear, which the mentioned actuator operates.

In order to process the control signals necessary for achieving this aim, a control unit, which is included in the control device, is used. This control unit is needed to know in real time the position of the movable parts of the electric switchgear.

This is obtained, in the embodiments described in the mentioned patent application, using one or more feedback signal, which can provide the control unit with information, directly or indirectly related to the position of the movable parts of the electric switchgear.

This information can be provided in a direct manner, for example, with one or more feedback signals that can be sent by position and/or velocity and/or acceleration sensors, suitably placed in predefined points of the kinematic chain, which connects the actuator to the movable parts of the switchgear. As it can be easily understood, this approach has the main drawback of requiring the placement of dedicated sensors for generating feedback signals for providing the control unit, in a direct or indirect manner, with information related to the position of movable parts the switchgear.

Alternatively, this information can be provided, in an indirect manner, avoiding the use of position sensors. In fact, in this case, feedback signals, related the control parameters of the actuator, are generated by current/voltage sensors and subsequently sent to the control unit of the control device. In this way, the position of the movable parts can be calculated by the control unit. Also this solution, even if achieving the aims for which it has been conceived, has some drawbacks, such as the need of complex electronics (and related setting-up procedures) for generating the control signals necessary for adjusting in real time the control parameters in input to the actuator.

SUMMARY

Therefore, the main aim of the present invention is to provide a device for controlling the opening/closing operation of an electric switchgear, which represents a further technical improvement with respect of the state of the art, in particular with respect of the invention disclosed in the patent application mentioned above.

Within this aim, another object of the present invention is to provide a device for controlling the opening/closing operation of an electric switchgear, which allows avoiding the use of sensors for generating feedback signals for providing the control unit, in a direct or indirect manner, with information related to the position of movable parts the switchgear.

Another object of the present invention is to provide a device for controlling the opening/closing operation of an electric switchgear, which allows using a relatively simple and low cost electronics for generating the control signals necessary for adjusting in real time the control parameters in input to the actuator.

Another object of the present invention is to provide a device for controlling the opening/closing operation of an electric switchgear, which allows using simple procedures for setting-up the electronics for generating the control signals necessary for adjusting in real time the control parameters in input to the actuator.

Another object of the present invention is to provide a device for controlling the opening/closing operation of an electric switchgear, which allows controlling the movable parts of the switchgear with an high level of reliability, improving the electric and mechanical life of the switchgear.

Not the least object of the present invention is to provide a device for controlling the opening/closing operation of an electric switchgear, which is of simple and relatively low cost realisation.

Thus, the present invention provides a device for controlling the opening/closing operation of an electric switchgear in a power distribution network, which comprises:

- a movable contact and a fixed contact that can be separated/coupled during the opening/closing operation of the switchgear;
- an electromagnetic actuator having a law of motion, which can be adjusted by a control unit, this electromagnetic actuator being operatively connected, by means of a kinematic chain, to the movable contact.

The device, according to the present invention, is characterised by the fact that the mentioned control unit comprises a first processing means for generating, based on predefined data, a first control signal, which is indicative of the actual law of motion of the movable contact operated by the electromagnetic actuator. The device according to the present invention allows achieving the intended aims. In fact, the presence of the mentioned first processing means, which generate, based on predefined data, the first control signal, allows avoiding the need of one or more feedback signals that directly or indirectly, provide information related to the position of the movable contact.

In practise, the first processing means generate the first control signal, which is indicative of the actual law of motion of the movable contact operated by the electromagnetic actuator, basing uniquely on predefined data that are already available in the control unit.

In this way, it is possible to use relatively a simple, low cost and easily settable electronics for generating the control signals necessary for adjusting in real time the control parameters in input to the actuator

BRIEF DESCRIPTION OF THE DRAWINGS

Further characteristics and advantages of the invention shall emerge more clearly from the description of preferred but not exclusive embodiments of the device, according to the present invention. The preferred embodiments of the device, according to the present invention, are illustrated purely by way of example and without limitation in the attached drawings, wherein.

DETAILED DESCRIPTION

Figure 1:
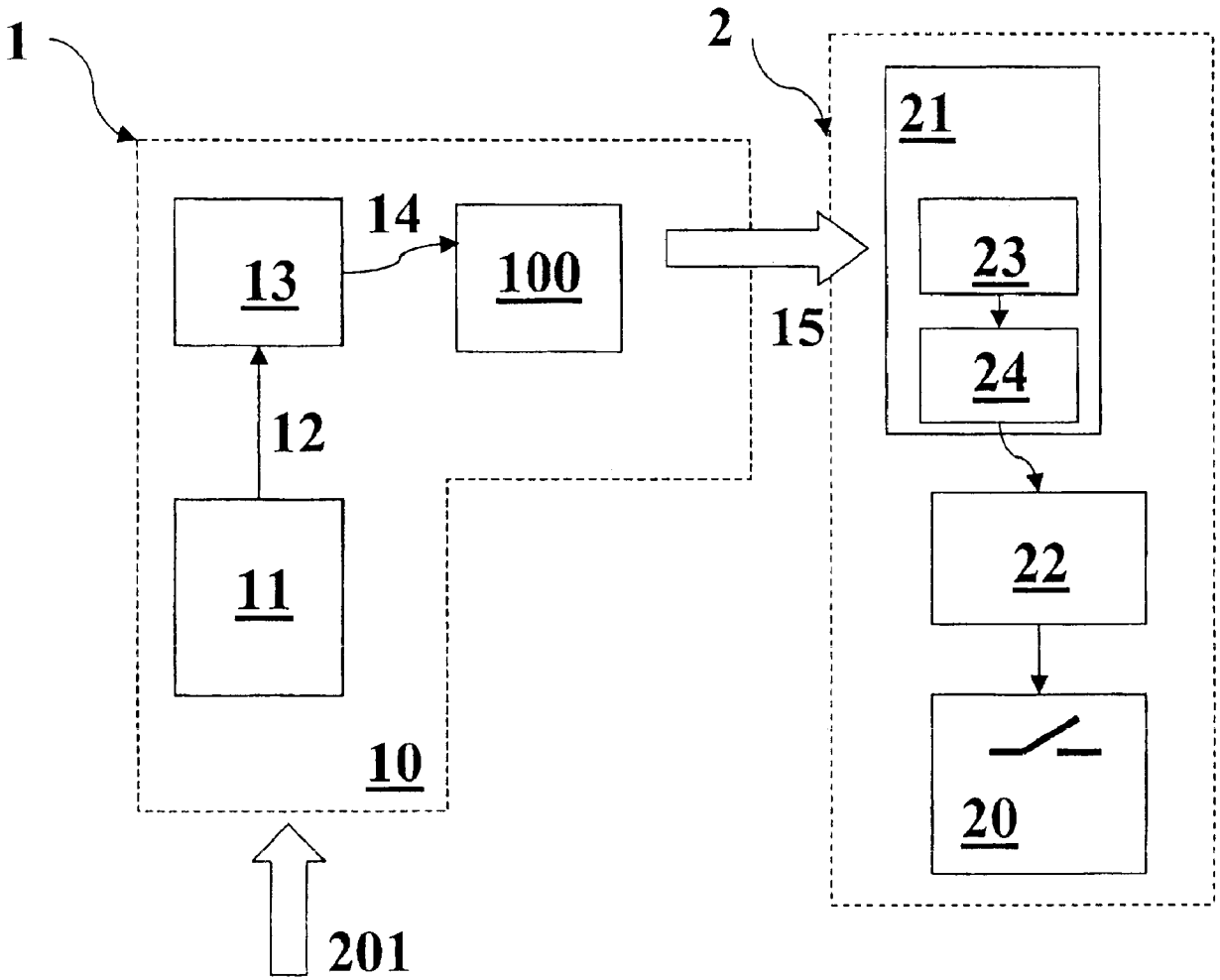
FIG. 1 is a diagram, which illustrates a schematic view of the device, according to the present invention.

Referring to FIG. 1, the device 1, according to the present invention, controls the opening/closing operation of an electric switchgear 2, in a power distribution network (not illustrated). The switchgear 2 comprises a movable contact and a fixed contact, globally indicated by reference 20, that can be separated/coupled during the opening/closing operation of the switchgear 2. The switchgear 2 comprises an electromagnetic actuator 21 having a law of motion, which can be adjusted by a control unit 10. The electromagnetic actuator 21 is operatively connected, by means of a kinematic chain 22, to the movable contact. The electromagnetic actuator 21 comprises preferably an excitation circuit 23, for generating a magnetic flux and a movable element 24, operatively connected to the movable contact by means of the kinematic chain 22. The movable element 24 is operated by the magnetic force, which is generated by a portion of the magnetic flux, which is enchaned with the movable element 24.

The control unit 10 comprises a first processing means 11 for generating, based on predefined data (not shown), a first control signal 12, which is indicative of the actual law of motion of the movable contact of the switchgear 2, which is operated by the electromagnetic actuator 21.

The control unit 10 comprises second processing means 13, which receive the first control signal 12 and generate a second control signal 14 for controlling (arrow 15) the flow of energy supplied to the actuator 21.

Figure 2:
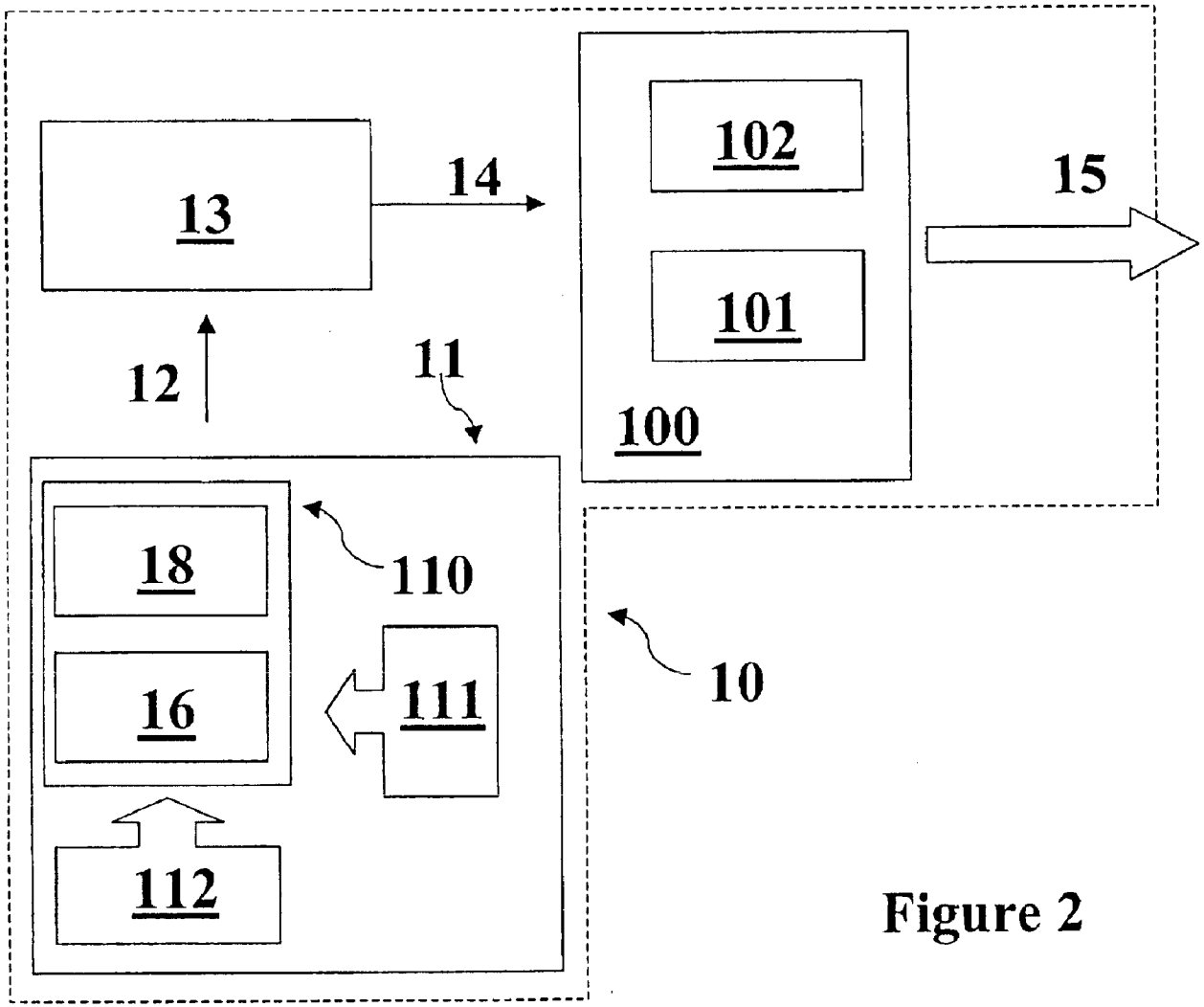
FIG. 2 is a diagram, which illustrates a schematic view of a detail of the device according to the present invention.

For reaching this aim, referring now also to FIG. 2, the control unit 10 comprises converting means 100, which receive the second control signal 14 and modulate the flow of energy supplied to the actuator 21. The power supply means 100 comprise means 101 for supplying (arrow 15) power to the actuator 21 and means 102 for modulating the amount of power supplied, in relation to the second control signal 14. Advantageously, the power supply means 101 supply power to the excitation circuit 23 of the actuator 21.

Referring to FIG. 2, the first processing means 11 comprise estimating means 110 for determining, based on predefined data (not shown) related to the operating conditions of the electromagnetic actuator 21, the actual law of motion of the movable contact.

The mentioned predefined data are already available to the control unit and can be memorised using simple control procedures, that take into account the operating conditions of the actuator 21, that are known "per sé".

This fact facilitates the use of control digital techniques (for example by means of a microprocessor) for the generation of the first control signal 12 and/or the second control signal 14.

In order to storage the predefined data related to the operating conditions of the actuator 21, the estimating means 110 comprise first storage means 16, for memorising data that are related to the law of motion of the actuator 21. Preferably, as it will described better hereinafter, this law of motion is expressed as a function of the portion of magnetic flux, which is enchaned with the movable element of the electromagnetic actuator 21. Moreover, the estimating means 110 can comprise second storage means 18 for memorising data (not shown) related to operating parameters of the electromagnetic actuator 21. Preferably, in the second storage means 18, data related to the voltage and current applied to the excitation circuit 23 of the electromagnetic actuator 21 and data related to the working temperature of the actuator 21 are memorised.

In a preferred embodiment, for the sake of implementing a redundancy system, the actuator 21 can provide the control unit with a comparison signal (not illustrated), indicative of the value of magnetic flux, generated by the excitation circuit of the actuator 21. This can be easily obtained, without any complication of the control unit electronics, arranging, in a proper manner, the excitation circuit 23.

The first processing means 11 comprise preferably means 111 for estimating the equivalent resistance of the excitation circuit 23 and means 112 for calibrating the estimating means 110 to the actual position of the movable contact of the actuator. The means 11 and 112 are particularly useful for ensuring a reliable control of the actuator 21.

Figure 3:
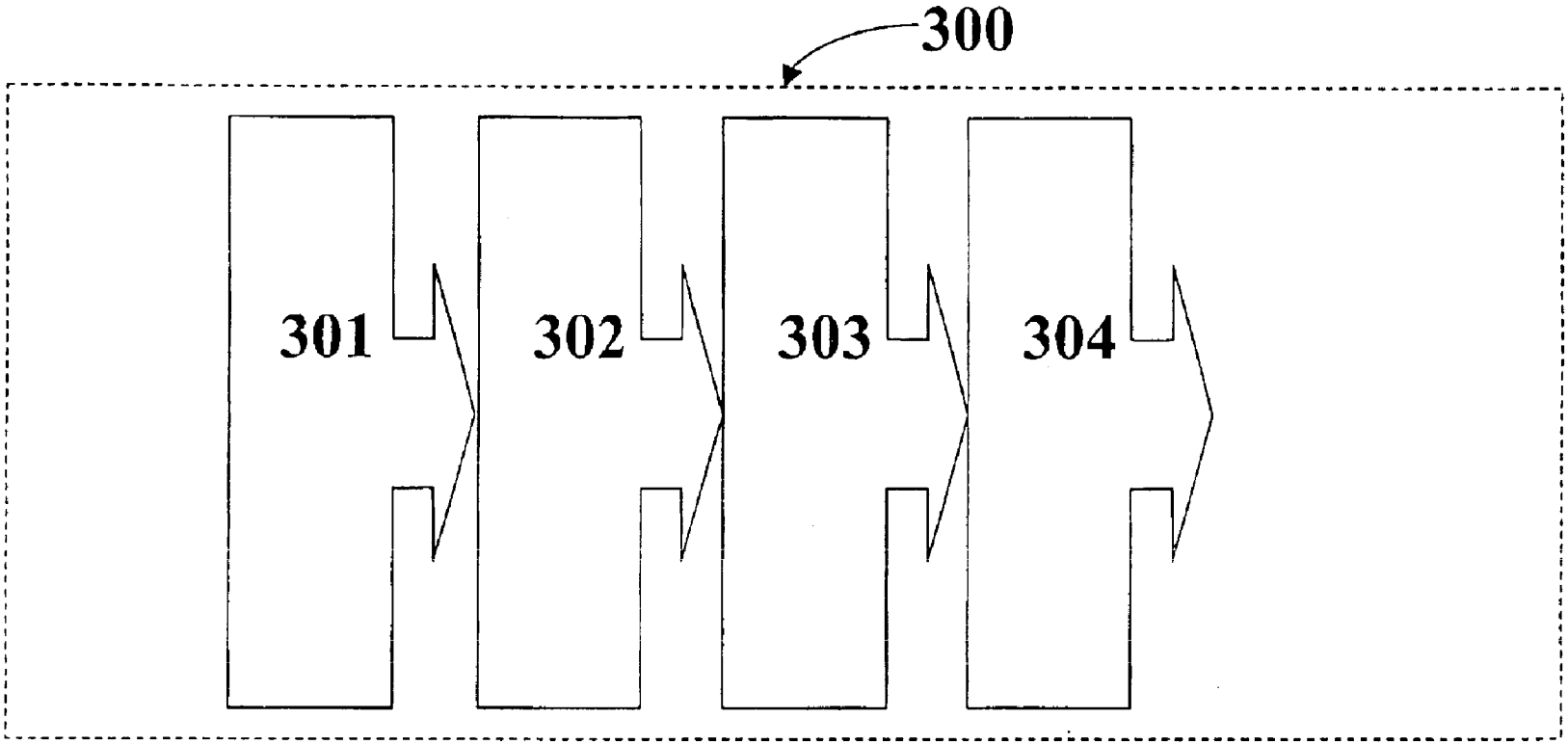
FIG. 3 is a diagram, which illustrates a schematic view of a possible succession of phases related to a control method that can be implemented in the device, according to the present invention.

The device according to the present invention allows the implementation of a control method 300, which is described hereinafter, referring to FIG. 3.

At it will appears evident hereinafter, the control method 300 allows appreciating the advantages of the device according to the present invention.

The control method 300 includes advantageously a succession of phases, which preferably comprises the phase a) (reference 301) of generating an operating command signal (reference 201 of FIG. 1) for the control unit 10. This operating command signal can be used for activating the control unit 10. Then, it can be provided the phase b) (reference 302) of generating, by means of the first processing means 11, the first control signal 12. As mentioned, the generation of the control signal 12 is performed based on predefined data related to the operating conditions of the actuator 21.

Preferably the phase b) comprises the steps b.1) of determining, by means of the estimating means 110, the actual law of motion of the electromagnetic actuator 21 and the step b.2) of processing the first control signal, based on the step b.1).

Preferably the step b.1) comprises the sub-step i. of acquiring, from the first storage means 16, first predefined data (not shown) that are related to the law of motion of the electromagnetic actuator 21. These data are preferably expressed as a function of the portion of the magnetic flux, which is enchaned with the movable element of the electromagnetic actuator 21. Accordingly, it can provided the sub-step ii. of acquiring, from the second storage means 18, second predefined data (not shown) that are related to the operating parameters of the electromagnetic actuator 21.

In a preferred embodiment the sub-step ii. comprises the sub-steps of:

acquiring, from the second storage means 18, predefined data related to the voltage and current applied to the excitation circuit of the electromagnetic actuator 21; and acquiring, from the second storage means 18, predefined data related to the operating temperature of the electromagnetic actuator 21.

Then, it is preferably provided the sub-step iii. of determining the actual portion of magnetic flux, which is enchaned with the movable element of the electromagnetic actuator 21 and the sub-step iv. of estimating the equivalent resistance of the excitation circuit 23.

This estimation can be run in practice during the set-up procedures. It can be implemented, for example, injecting a step of current into the excitation circuit 23 of the actuator 21 and measuring the time constant of the response of the excitation circuit 23.

Finally the sub-step v. of calculating the actual position of the movable element of the electromagnetic actuator 21 can be easily performed.

The phase b) and in particular the step b.1) finds their foundation in the following theoretical considerations.

By means of a detailed analysis of the structure of the electromagnetic actuator 21, a function $\Phi_1$ which express the flux $\Phi$ as a function of the position x of the movable element of the actuator and of the current $I_C$ circulating in the excitation circuit of the actuator. So it can be written the following relation:

$$\Phi(t)=\Phi_1(x(t),Ic(t)) \quad (1).$$

The mentioned analysis can comprise preferably F.E. (Finite Element) modelling procedures while this relation can be memorised, for example in form of a table, in the first storage means 16. As mentioned, for the sake of redundancy, this table can be compared with a second table, in which the flux values can be provided by a comparison signal, sent by the actuator 21.

If also the voltage Vc and the equivalent resistance Rc of the excitation circuit 23 are known it can be written that:

$$\Phi(t) = \Phi(0) + \int_{-0}^{t} (Vc(y) - Rc \cdot Ic(y))\, dy, \quad (2)$$

where $\Phi(0)$ is the initial value of the magnetic flux at the initial instant that can be acquired from the first storage means 16.

At this stage, combining the relations (1) and (2), the value of the position x(t) of the movable element of the actuator 21 can be calculated using the following relation:

$$x(t)=\Phi_1^{-1}(\Phi(t),Ic(t)) \quad (3)$$

Once the position x(t) is known, it is easy to obtain the position $\underline{x}$(t) of the movable contact of the switchgear and accordingly generating the first control signal 14, which is indicative of the law of motion of the movable contact of the switchgear.

For the practical implementation of this principle, it is necessary to take into account in the previous calculation the influence of the working temperature of the actuator 21, which can be taken into account in the relation (2). Moreover, in order to ensure a more reliable implementation of the theoretical relations above illustrated, it can be provided the sub-step vi. of calibrating the estimating means 110 to the actual position of the movable element of the electromagnetic actuator 21.

Further it can be provided the phase c) (reference 303) of generating, by means of the second processing means 13, the second control signal 14. The generation of the second control signal 14 allows performing the subsequent phase d) (reference 304) of modulating, by means of the converting means 100, the flow of energy supplied to the electromagnetic actuator 21. So, it can be adjusted the force, which the electromagnetic actuator 21 exerts on the kinematic chain 22, in order to obtain a desired law of motion for the movable contact.

In a preferred embodiment of the control method 300, the phase c) comprises the steps c.1) of comparing the first control signal 12 with one or more reference signals (not illustrated). The mentioned reference signals are indicative of a predetermined law of motion of the movable contact operated by the electromagnetic actuator 21. Then, the step c.2) of processing the second control signal 14, based on the step c.1), may be provided. In practice, a closed loop control scheme can be used for generating the second control signal 14.

It has been proven in practice that the device for controlling the opening/closing operation of an electric switchgear allows achieving the intended aims.

In particular a simple and reliable electronics can be used in the control unit 10. This can be obtained thanks to the presence of the first processing means 11 that allow to generate the first control signal 12 basing on data that are substantially already available to the control unit 10. In this manner, it can be avoided the need of reporting feedback signals, especially using external sensors. As described above, it has been made possible to implement simple control procedures, that are particularly suitable for the implementation by means of a microcontroller.

The device according to the present invention is susceptible of numerous modifications and variations, all of which are within the scope of the inventive concept. All the details may furthermore be replaced with other technically equivalent elements.

What is claimed:

1. A device for controlling the opening/closing operation of an electric switchgear in a power distribution network, said switchgear comprising:

a movable contact and a fixed contact that can be separated/coupled during the opening/closing operation of said switchgear;

an electromagnetic actuator having a law of motion which can be adjusted by a control unit, said electromagnetic actuator being operatively connected, by means of a kinematic chain, to said movable contact; wherein said control unit comprises a first processing means comprising:

first storage means for memorizing predefined data related to the law of motion of said actuator;

second storage means for memorizing predefined data related to the operating parameters of said electromagnetic actuator; said first processing means determining, based on said predefined data related to operating parameters of said electromagnetic actuator and on said predefined data related to the law of motion of the electromagnetic actuator itself, the actual law of motion of said movable contact operated by said actuator and generating a first control signal which is indicative of said actual law of motion.

2. A device according to claim 1, wherein said electromagnetic actuator comprises:

an excitation circuit for generating a magnetic flux; and a movable element operatively connected to said movable contact by means of said kinematic chain, said movable element being operated by a magnetic force which is generated by a portion of said magnetic flux which is enhanced with said movable element.

3. The device of claim 1, wherein the first processing means comprise estimating means for determining, based on said predefined data related of the operating conditions of the electromagnetic actuator, the actual law of motion of said movable contact operated by said actuator.

4. The device of claim 3, wherein the first processing means comprise means for calibrating to an actual position of the movable element of said electromagnetic actuator.

5. The device of claim 1, wherein the first processing means further comprises means for estimating an equivalent resistance of an excitation circuit of said electromagnetic actuator.

6. The device of claim 3, wherein the first processing means further comprises means for calibrating said estimating means for determining to an actual position of the movable element of the electromagnetic actuator.

7. The device of claim 1, wherein the control unit further comprise a second processing means, which receive said first control signal and generates a second control signal for controlling a flow of energy supplied to said electromagnetic actuator.

8. The device of claim 7, further comprising converting means which receive said second control signal and modulate a flow of energy supplied to said electromagnetic actuator.

9. The device of claim 8, wherein the converting means comprise power supply means for supplying power to said electromagnetic actuator and means for modulating an amount of power supplied by said power supply means to an excitation circuit of said electromagnetic actuator.

10. The device of claim 9, wherein the power supply means supply current to the excitation circuit of said electromagnetic actuator.

11. A method of controlling an opening/closing operation of an electric switchgear, the method comprising:

a) generating an operating command signal for a control unit;

b) generating, based on predefined data, a first control signal, which is indicative of an actual law of motion of a movable contact operated by an electromagnetic actuator;

c) based on said first control signal, generating a second control signal which controls a flow of energy supplied to said electromagnetic actuator; and d) based on said second control signal:

modulating a flow of energy supplied to the electromagnetic actuator;

adjusting a force which said electromagnetic actuator exerts on a kinematic chain; and obtaining a desired law of motion for the movable contact.

12. The method of claim 11, wherein stop b) comprises:

b.1) determining the actual law of motion of the electromagnetic actuator; and b.2) based on step b.1), processing the first control signal.

13. The method of claim 12, wherein step b.1) comprises:

i. acquiring first predefined data that are related to the law of motion of the electromagnetic actuator, the data being expressed as a function of a portion of a magnetic flux which is enhanced by the movable element of the electromagnetic actuator;

ii. acquiring second predefined data that we related to operating parameters of the electromagnetic actuator;

iii. determining an actual portion of magnetic flux which is enhanced by the movable element of the electromagnetic actuator;

iv. estimating the equivalent resistance of the excitation circuit of said electromagnetic actuator; and v. calculating the actual position of said movable element of said electromagnetic actuator.

14. The method of claim 13, wherein step b.1) further comprises:

vi. calibrating an estimated position of the movable element to an actual position of the movable element of said electromagnetic actuator.

15. The method of claim 13, wherein step ii. comprises:

acquiring predefined data related to a voltage and current applied to the excitation circuit of the electromagnetic actuator; and acquiring predefined data related to an operating temperature of the electromagnetic actuator.

16. The method of claim 11, wherein step c) comprises:

c.1) comparing the first control signal with one or more reference signals which are indicative of a predetermined law of motion of the movable contact operated by said electromagnetic actuator; and c.2) based on said step c.1) processing said second control signal.

17. A device according to claim 2, wherein said first processing means comprise estimating means for determining, based on said predefined data related of the operating conditions of said electromagnetic actuator, the actual law of motion of said movable contact operated by said actuator.

18. A device, according to claim 2, wherein said first processing means comprise means for estimating the equivalent resistance of the excitation circuit of said electromagnetic actuator.

19. A device, according to claim 3, wherein said first processing means comprise means for estimating the equivalent resistance of the excitation circuit of said electromagnetic actuator.

* * * * *